United States Patent [19]

Gersch

[11] 4,135,575

[45] Jan. 23, 1979

[54] TUBE WALL MADE OF TUBES WHICH EXTEND PARALLEL TO ONE ANOTHER AND HORIZONTAL TO INCLINED

[75] Inventor: Karl H. Gersch, Ratingen, Fed. Rep. of Germany

[73] Assignee: Balcke-Durr Aktiengesellschaft, Ratingen, Fed. Rep. of Germany

[21] Appl. No.: 794,610

[22] Filed: May 6, 1977

[30] Foreign Application Priority Data

May 13, 1976 [DE] Fed. Rep. of Germany ..... 2621190

[51] Int. Cl.[2] ..... F28F 1/22

[52] U.S. Cl. ..... 165/171; 122/6 A

[58] Field of Search ..... 122/61 A, DIG. 15; 165/171

[56] References Cited

U.S. PATENT DOCUMENTS

| | | | |
|---|---|---|---|
| 1,774,150 | 8/1930 | Murray | 122/6 A |
| 2,162,083 | 6/1939 | Higham et al. | 165/171 |
| 2,594,232 | 4/1952 | Stockstill | 165/172 |
| 3,384,167 | 5/1968 | Javkin | 165/171 |

FOREIGN PATENT DOCUMENTS

| | | | |
|---|---|---|---|
| 275898 | 8/1913 | Fed. Rep. of Germany | 122/6 A |
| 2153965 | 5/1973 | Fed. Rep. of Germany | 122/6 A |
| 21066 of | 1893 | United Kingdom | 165/171 |
| 564649 | 10/1944 | United Kingdom | 122/6 A |
| 1110439 | 4/1968 | United Kingdom | 122/6 A |

*Primary Examiner*—Charles J. Myhre
*Assistant Examiner*—Sheldon Richter
*Attorney, Agent, or Firm*—Martin A. Farber

[57] ABSTRACT

A tube wall made of tubes extending parallel to one another and horizontally to inclined, which are provided with opposite fins on the longitudinal edges of which adjacent tubes are welded gas-tight to one another. The fins are formed as a continuous band exceeding in width the outer diameter of the tube. The band is arranged tangentially on the outside of the tube and the bands, which are welded with each other, are suspendable on a supporting structure for assuming the forces resulting from the dead weight of the tube wall and from additional loads.

6 Claims, 3 Drawing Figures

Figure 1:
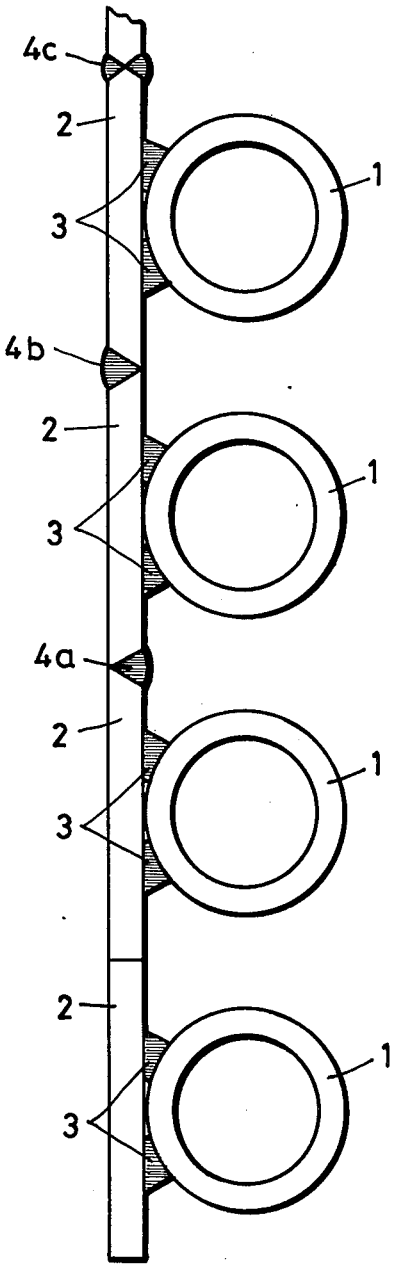

TUBE WALL MADE OF TUBES WHICH EXTEND PARALLEL TO ONE ANOTHER AND HORIZONTAL TO INCLINED

The invention relates to a tube wall made of tubes which extend parallel to one another and horizontal to inclined, which are provided with opposite fins, on the longitudinal edges of which adjacent tubes are welded gas-tight with one another.

For the production of gas-tight welded tube walls, tubes with the fins connecting the individual tubes, are known as so-called fin-tubes, in various embodiments and for a long time. They are used not only for the production of tube walls with vertical or perpendicular tube course, but also for helically formed wound tube walls, as they for example find use for combustion chambers.

By the development of always larger boiler units, with such type of combustion chamber walls with substantially horizontal to inclined tube course, there occurs the problem of the loading capacity or load carrying ability of the individual tubes transversely to their longitudinal direction, since such type of membrane walls must carry their own weight or deadweight and additional loads. Upwards of a certain level, with the tube walls produced from the known finned tubes it is necessary to provide additional carrier or supporting elements, such as for example tension chords or belts, which unload the tube wall and introduce the forces into the supporting construction of the boiler. Because of the differential elongations occurring between the tube wall and the supporting elements, expensive constructions, such as for example so-called constant hangers or supports are used, which in addition to a high constructive and thus costly expense, requires space and service as well as reparis under the circumstances.

The invention is based on the task to make a tube wall from fin tubes, which avoids impermissible loadings of the tubes transverse to their longitudinal direction and makes possible the production of tubes walls with horizontal to inclined tube course with great heights in self-supporting execution, without the necessity of additional supporting structures.

The solution of this object is characterized by the invention in the manner that the fins are formed as a continuous band exceeding in the width the outer diameter of the tube, which band is arranged tangentially on the outside of the tube, and that the bands which are welded with one another can be suspended on a supporting structure for assuming the forces resulting from the dead weight of the tube wall and from additional loads.

With this proposal of the invention a tube wall is manufactured, the loading of which transversely to the tube axis is assumed substantially by the band which is arranged tangentially to the body of the tubes, so that the actual tube bodies are kept free or clear of forces which for example originate by the dead weight and additional loads of the tube wall, and indeed independent of the position of the tubes. The actual tube body substantially is only loaded by the pressure and the strains arising for example with a heating. This division of the loadings on the actual tube bodies and the band arranged tangential to the latter make possible a very good adaptation or correlation of the individual dimensions of the fin-tube to the load cases from time to time and consequently the construction or assembling of self-supporting tube walls of any arbitrary height. Also with a substantially horizontal tube course, as it for example is present with a helically-formed wound tube wall for the formation of a combustion chamber, the construction in accordance with the present invention has the advantage that the tube body is not loaded by the tensile forces from weight and additional loads, which forces are applied transversely to its longitudinal direction. Consequently the self-supporting construction height of such a tubular wall can be selected corresponding to the dimensions realizable today, because the thickness of the band can be dimensioned corresponding to the forces which occur. Further advantages of the invention result in the manner that the spacing of adjacent tubes can be selected independent of the loading of the fins, because for the formation of a gas-tight welded tube wall it is merely necessary that the width of the band slightly exceeds the outer diameter of the tube. Finally with the present arrangement under the circumstances of tension or tie rods or other supporting devices on the outer side of a heated tubular wall, a very good heat flow is achieved between the tubes and the construction elements arranged on the outer side of the bands, because these engage directly on the bands or can be welded with them.

According to further features of the invention the band can be welded on the tube or the band and the tube can be integrally produced. In the latter case the band can be executed approximately in or with the wall thickness of the tube or also thicker or stronger than this, so that with the selection of the dimensions of the band, the loadings of the fin-tube can be considered transverse to its longitudinal direction. Finally with the invention it is proposed to connect the bands additionally by means of vertically or perpendicularly extending tension chords with one another and with the supporting structure.

Figure 2:
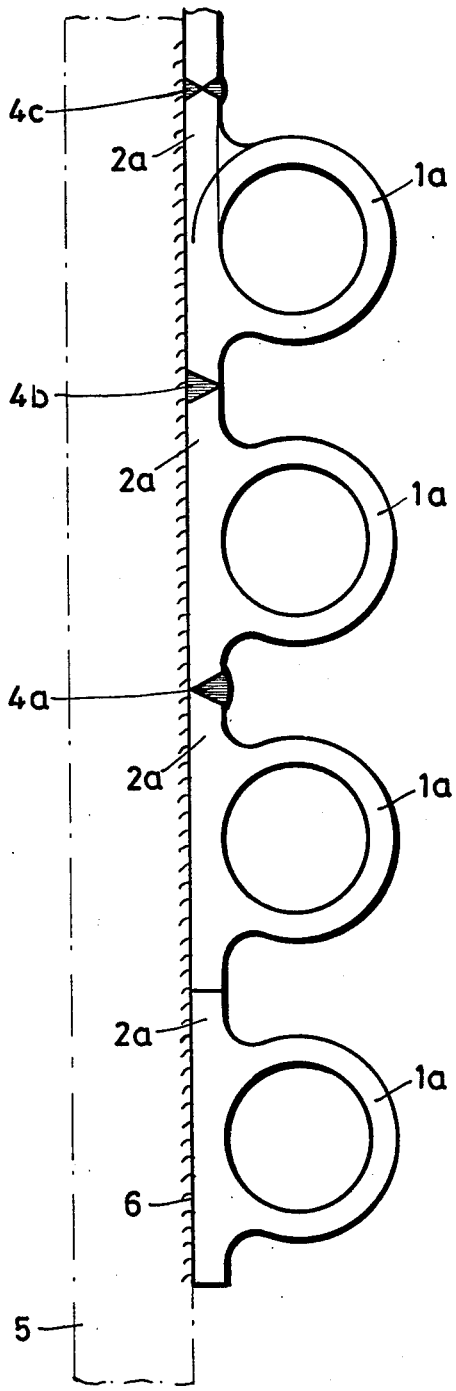
Figure 3:
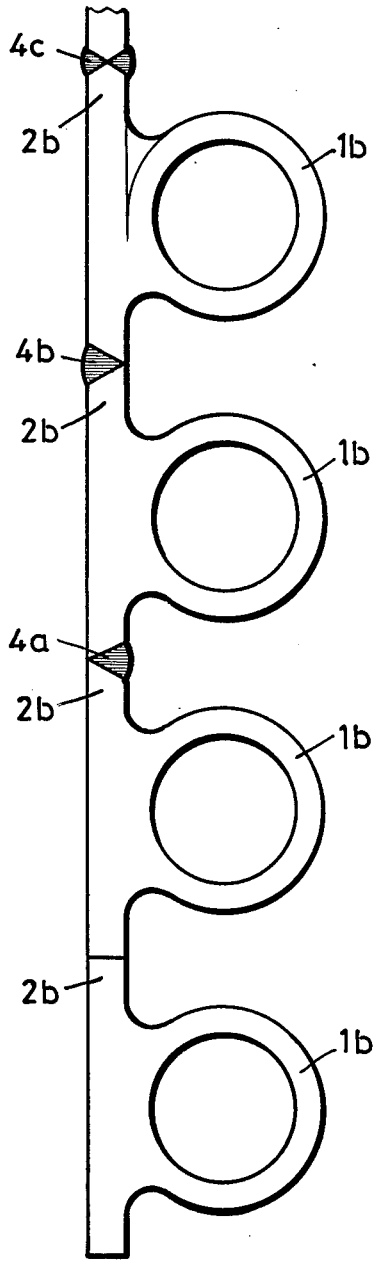

In the drawings three embodiment examples of the tube wall in accordance with the present invention are illustrated, and indeed show:

FIG. 1 the front view of a tube wall, the tubes of which are produced of cylindrical tubes and bands, FIG. 2 a front view of a tube wall with tubes, the tube bodies and fins of which are produced integrally and which additionally are suspended on one tension chord, and FIG. 3 the front view of a third embodiment form of a tube wall with integrally produced fin tubes.

With all three embodiment examples, the finned tubes possess a cylindrical tube body and fins, which fins are formed by a band arranged tangentially to the tube body. This band is arranged on the unheated side of the tube body, which of course can also have a cross-section differing from the circular form.

With the embodiment example according to FIG. 1, the tube body is formed by a cylindrical tube 1, on which on the side facing away from the heating, a band 2 is welded thereon, the width of the latter exceeding the diameter of the tube 1. The welding of the band 2 with the tube 1 with the illustrated embodiment example, takes place by two welding seams 3. Of course it is possible instead of these two welding seams 3, to provide only one welding seam or a series of welding points, so far as in this manner a sufficiently rigid connection between tube 1 and band 2 is guaranteed.

For the formation of the gas-tight welded tube wall, the finned tubes are welded with one another on adjacent longitudinal edges of the bands 2, as this is indicated by the welding seams **4*a*, 4*b*, and 4*c* in FIG. 1**.

From the illustration it may be recognized that the welding seam 4a was laid from the inner side of the tube wall, and the welding seam 4b to the contrary from the outside. With the welding seam 4c a welding occurs from the outside as well as from the inside.

By the welding of the bands 2 with one another not only is a gas-tight welded tube wall produced, but rather independent of the tubes 1 a continuous wall surface is produced, which can assume or receive all forces which come from the dead weight and from additional loads without stressing of the tube 1. With the embodiment according to FIG. 1 it is consequently possible to eliminate the dimensioning of the tube 1 to this loading by the internal pressure and possible heating strains and to assume the remaining loadings of the tube wall by corresponding dimensioning of the band 2. From FIG. 1 it may further be recongized that the spacing of the tubes 1 from one another can be freely selected, since attention merely must be paid that the longitudinal edges of the bands 2 can be welded with one another. The tube division consequently may be freely selected independent of the carrying capacity or load of the bands 2.

With the embodiment example according to FIG. 2, a finned tube is used, the tube 1a and band 2a of which are integrally produced, for example by rollers or extrusion devices, whereby the thickness of the band 2a is only slightly greater than the wall thickness of the tube 1a as is to be recognized in the upper part of FIG. 2. The adjacent longitudinal edges of the bands 2a are furthermore welded with one another by means of welding seams 4a or 4b or 4c.

When with the formation of a for example, helically-shaped wound tube wall made of the finned tubes according to FIG. 2, the loadings or strains resulting from the dead weight and additional forces are not able to be assumed by the bands 2a, a tension chord or belt 5 can be arranged on the outerside of the finned tubes, as it is illustrated with dash-dot lines in FIG. 2. This tension belt 5 is welded with the bands 2a by means of one or more welding seams 6 extending in the vertical or perpendicular direction. Since the tension belt 5 on its entire width engages flat on the bands 2a of the finned tubes, there results optimum heat transfer or bridge between the tube wall which is produced of the finned tubes and the tension belt which is provided as the support element, so that with such type of construction only small temperature difference occur between tube wall and support element even with temperature changes inside of the tube wall.

With FIG. 3 finally a further embodiment possibility is shown of a tube wall with use of a finned tube which integrally is made of a tube 1b and a band 2b. With this third embodiment form, the band 2b has a thickness which considerably lies over the wall thickness of the tube 1b, so that the bands 2b, which are welded with one another, can transmit forces to the tube 1b without noteworthy reactions or back effects. In this manner in the most cases, even with large tube wall dimensions it is unnecessary to arrange additional carrier or support elements, as for example tension chords or belts. Also in the case of the embodiment according to FIG. 3, different types of the welding can be provided between the longitudinal edges of the bands 2b, as this is indicated with the welding seams 4a, 4b, and 4c.

I claim:

1. A tube wall suspendable from a supporting structure for assuming the forces resulting from the dead weight of the tube wall and from additional loads, comprising a plurality of tubes extending parallel to one another and horizontal to inclined, said tubes include oppositely directed fins, the latter having longitudinal edges welded gas-tight respectively to one another, adjacent of said tubes thereby being operatively welded gas-tight to one another, said fins, respectively, being formed as a continuous band having a width exceeding the outer diameter of said tubes, respectively, said band being connected tangentially on an outerside of said tube, respectively, such that the thickness of the connection is at least as thick as the sum of the thickness of the tube and band, said bands being adapted to be suspended from the supporting structure, a tension chord forming one-piece with said tubes and constituting said band, the latter having a surface facing said tubes substantially tangentially aligned with the adjacent imaginary outer periphery of said tubes.

2. The tube wall according to claim 1, wherein said bands are welded to said tubes, respectively.

3. The tube wall according to claim 1, wherein said bands and said tubes respectively are formed integrally.

4. The tube wall according to claim 3, wherein said bands have a thickness corresponding approximately to the wall thickness of said tubes, respectively.

5. The tube wall according to claim 3, wherein characterized in the said bands have a thickness exceeding the wall thickness of said tubes.

6. A tube wall suspendable from a supporting structure for assuming the forces resulting from the dead weight of the tube wall and from additional loads, comprising a plurality of tubes extending parallel to one another and horizontal to inclined, said tubes include oppositely directed fins, the latter having longitudinal edges welded gas-tight respectively to one another, adjacent of said tubes thereby being operatively welded gas-tight to one another.

said fins, respectively, being formed as a continuous band having a width exceeding the outer diameter of said tubes, respectively, said band being connected tangentially on an outerside of said tube, respectively, said bands being adapted to be suspended from the supporting structure, tension chords extend perpendicularly to said bands and are connected with said bands additionally connecting said bands with one another and with the supporting structure.

* * * * *